US006419723B2

(12) United States Patent
Hirota et al.

(10) Patent No.: US 6,419,723 B2
(45) **Date of Patent: *Jul. 16, 2002**

(54) THIN RIBBON OF RARE EARTH-BASED PERMANENT MAGNET ALLOY

(75) Inventors: Koichi Hirota; Takahiro Hashimoto; Koji Sato; Kenji Yamamoto; Takehisa Minowa, all of Fukui-ken (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/943,273

(22) Filed: Aug. 31, 2001

Related U.S. Application Data

(62) Division of application No. 09/588,536, filed on Jun. 7, 2000, now Pat. No. 6,322,637.

(30) Foreign Application Priority Data

Jun. 8, 1999 (JP) ..... 11-160648

(51) Int. Cl.[7] ..... C22C 29/14
(52) U.S. Cl. ..... 75/244; 148/302
(58) Field of Search ..... 148/302, 101, 148/102, 103, 104; 75/244; 419/12

(56) References Cited

U.S. PATENT DOCUMENTS 4,765,848 A * 8/1988 Mohri et al. ..... 148/302
4,770,702 A 9/1988 Ishigaki et al.
4,859,254 A 8/1989 Mizoguchi et al.
4,919,732 A * 4/1990 Yang et al. ..... 148/103
5,011,552 A 4/1991 Otsuka et al.
5,041,172 A 8/1991 Tokunaga et al.
5,071,493 A 12/1991 Mizoguchi et al.
5,110,377 A 5/1992 Yamamoto et al.
5,123,979 A 6/1992 Tenaud et al.
6,319,335 B1 * 11/2001 Hirota et al. ..... 148/302
6,322,637 B1 * 11/2001 Hirota et al. ..... 148/302

FOREIGN PATENT DOCUMENTS

EP 0 286 357 10/1988
EP 0 633 581 1/1995

OTHER PUBLICATIONS

Meekison et al., IEEE Transactions on Magnetics, 26(No. 5), pp. 1736–1738 (1990).
Bernardi et al., Journal of Applied Physics, 83(No. 11, part 2), pp. 6396–6398 (1998).

* cited by examiner

*Primary Examiner*—John Sheehan
(74) *Attorney, Agent, or Firm*—Wenderoth, Lind & Ponack, L.L.P.

(57) ABSTRACT

Disclosed is a thin alloy ribbon prepared by the strip casting method as an intermediate for the preparation of a sintered rare earth-based permanent magnet or, in particular, a neodymium/iron/boron-type permanent magnet. The thin alloy ribbon is characterized by a specific volume fraction of the four-phase coexisting region consisting of the α-iron phase, R-rich phase, $R_XT_4B_4$ phase and $R_2T_{14}B$ phase each having an average grain diameter in a specified range and a specific volume fraction of the chill crystalline phase. When these requirements are satisfied, the sintered rare earth-based permanent magnet prepared from the thin alloy ribbons can be imparted with improved magnetic properties and high sintering density even without increasing the sintering temperature.

3 Claims, 4 Drawing Sheets

THIN RIBBON OF RARE EARTH-BASED PERMANENT MAGNET ALLOY

This a divisional of Ser. No. 09/588,536, filed Jun. 7, 2000.

BACKGROUND OF THE INVENTION

The present invention relates to a thin ribbon of a rare earth-based permanent magnet alloy, referred to simply as a thin alloy ribbon hereinafter, or more particularly, to a thin alloy ribbon which can be an intermediate material for the preparation of a sintered permanent magnet of the R/T/B-type or, in particular, neodymium/iron/boron- type having excellent magnetic properties.

The application fields of permanent magnets are rapidly growing and expanding in recent years in a great variety of electric and electronic industries as a very important key component in household electric appliances, computers and communication instruments as well as marginal instruments thereof, medical diagnostic instruments and so on. In compliance with the recent trend of computers and communication instruments toward compactness in design and lightness in weight and requirements for environment preservation and energy saving, extensive investigations are now under way for the development of permanent magnets of higher and higher performance.

Among a variety of permanent magnet alloys thus far developed and now under practical use, the so-called R/T/B-type magnet alloys or, typically, the neodymium/iron/boron-type magnet alloys are highlighted in respects of their high magnetic properties and relatively low material costs among the rare earth-based permanent magnet alloys. The magnet alloys of this type are prepared usually by the metal-mold casting method or by the strip casting method.

In the above mentioned metal-mold casting method, the magnet alloy is obtained in the form of an ingot by casting a melt of the alloy into a metal-made casting mold. This method is advantageous because a magnet alloy of an exactly controlled chemical composition can readily be obtained, so that this method is widely employed. The metal-mold casting method, however, has a serious problem due to the relatively low rate of heat transfer between the casting mold and the alloy melt cast therein and within the magnet alloy per se necessitating a relatively long time for solidification of the molten alloy resulting in precipitation of the $\gamma$-iron phase as the primary crystals in the course of solidification of the molten alloy with remaining $\alpha$-iron phase of a coarse grain size of 10 $\mu$m or larger in the core portion of the ingot after solidification by cooling. In addition, the grain size of the R-rich phase and $R_xT_4B_4$ phase surrounding the $R_2T_{14}B$ phase also cannot be fine enough.

Since the cooling rate of the alloy is substantially different between the surface layer of the ingot adjacent to the walls of the casting mold and the core portion of the ingot, in addition, the $\alpha$-iron phase and R-rich phase as precipitated may have a wide variation in the grain diameters so that the particle size distribution of the alloy particles prepared by pulverization of the alloy ingot is broad due to the difficulties encountered in the pulverization of the ingot into fine particles of a particle diameter of a few micrometers. Accordingly, the magnet alloy particles are inferior in the behavior for magnetic orientation and sintering resulting in a decrease in the magnetic properties of the sintered permanent magnets as the final products.

In the strip casting method, on the other hand, a melt of the magnet alloy is continuously ejected at the surface of a rotating quenching roller of the single-roller type or twin-roller type so that the alloy melt is rapidly solidified on the roller surface in the form of a thin ribbon of the alloy having a thickness of 0.01 to 5 mm. This method is advantageous because of the possibility of controlling precipitation of the $\alpha$-iron phase and accomplishing fine and uniform dispersion of the $R_xT_4B_4$ phase by adequately selecting the quenching conditions of the alloy melt consequently leading to a uniform structure of the magnet to obtain high performance R/T/B-type permanent magnets.

Extensive investigations have been conducted on the metal-lographic structure of the thin alloy ribbon obtained by the strip carting method, sometimes referred to as a strip cast, with an object to upgrade the permanent magnets prepared from the thin alloy ribbons. For example, Japanese Patent No. 2639609, directing attention to the precipitation type of the $\alpha$-iron phase in and the metallographic structure of the strip casts, discloses a thin alloy ribbon having a structure in which $\alpha$-iron grains having a grain diameter smaller than 10 $\mu$m are dispersed as the peritectic nuclei in the crystalline grains of the principal phase. Japanese Patent Kokai 7-176414 proposes a thin alloy ribbon having a structure substantially free from segregation of the $\alpha$-iron phase. Further, Japanese Patent Kokai 10-317110 proposes, directing attention to the fine chill crystalline structure as formed in the vicinity of the solidification front, a rare earth-based magnet alloy for a base material of sintered permanent magnets.

Nevertheless, almost no investigations have been undertaken, in relation to the thin alloy ribbons obtained by the strip casting method directing attention to the four-phase coexisting region consisting of the $\alpha$-iron phase, R-rich phase, $R_xT_4B_4$ phase and $R_2T_{14}$ B phase as well as the chill crystals formed on and in the vicinity of the solidification front, on the correlation of the magnetic properties with the precipitation type and structure thereof.

SUMMARY OF THE INVENTION

The object of the present invention is therefore to provide a thin alloy ribbon capable of giving a high performance rare earth-based sintered permanent magnets of improved magnetic properties by positively utilizing the four-phase coexisting region and the chill crystalline phase.

Thus, the present invention provides a thin alloy ribbon as a base material of a sintered rare earth-based permanent magnet as prepared by the strip casting method from a melt of an alloy comprising a rare earth element R selected from the group consisting of praseodymium, neodymium, terbium and dysprosium, iron, optionally, in combination with a transition metal element other than iron and rare earth elements T and boron B, which comprises from 1 to 10% or, preferably, from 2 to 5% by volume fraction of the four-phase coexisting region consisting of the $\alpha$-iron phase having an average grain diameter of 0.1 to 20 $\mu$m, R-rich phase having an average grain diameter of 0.1 to 20 $\mu$m, $R_xT_4B_4$ phase, the subscript x being $1+\epsilon$, having an average grain diameter of 0.1 to 10 $\mu$m and $R_2T_{14}B$ phase having an average grain diameter of 0.1 to 20 $\mu$m and from 1 to 30% by volume fraction of a chill crystalline phase having an average grain diameter not exceeding 3 $\mu$m, the balance of the volume fractions consisting of a combination of the R-rich phase, $R_xT_4B_4$ phase and $R_2T_{14}B$ phase or a combination of the R-rich phase and $R_2T_{14}B$ phase.

The present invention is applicable particularly advantageously to a rare earth-based permanent magnet alloy of the R/T'/B-type or R/T/B/M-type (T=T'+M), of which R is a rare earth element, T' is iron or a combination of iron and cobalt and M is an element selected from the group consisting of titanium, niobium, aluminum, vanadium, manganese, tin, calcium, magnesium, lead, antimony, zinc, silicon, zirconium, chromium, nickel, copper, gallium, molybdenum, tungsten and tantalum and consisting of from 5 to 40% by weight of the rare earth element, from 50 to 90% by weight of the element T', from 2 to 8% by weight of boron and, if any, up to 8% by weight of the element M.

DETAILED DESCRIPTION OF THE PREFERRED EMBODIMENTS

Figure 1:
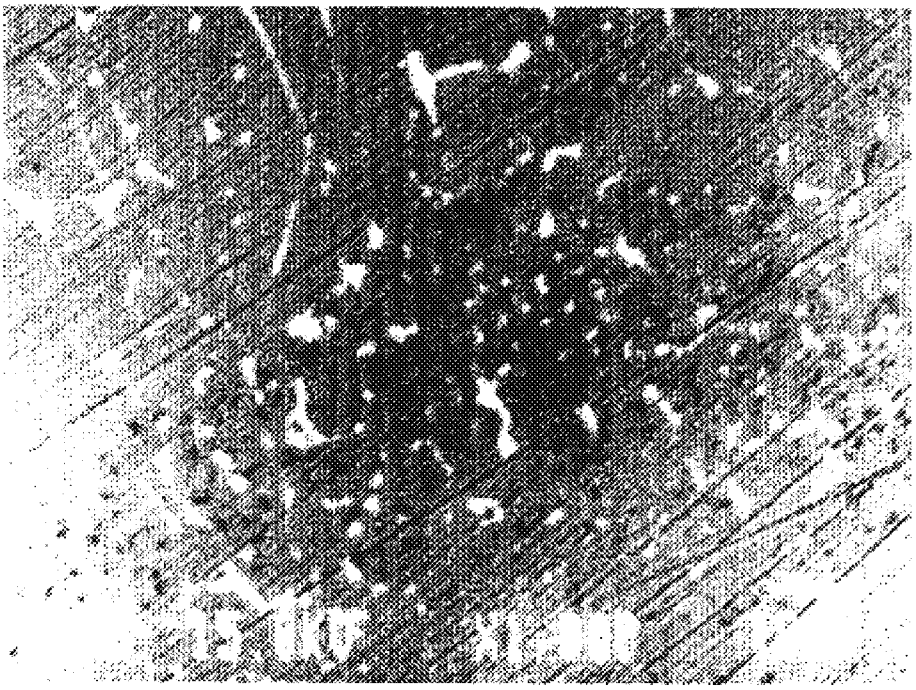
FIG. 1 is a reflection electron pattern of the four-phase coexisting region of the thin alloy ribbon for permanent magnets.

The above described thin alloy ribbon of the present invention has been established on the base of the inventors' discovery that the magnetic properties of the sintered permanent magnets are greatly influenced by the volume fraction of the four-phase coexisting region in the thin alloy ribbon precipitated when an alloy melt is quenched by the strip casting method and the average grain diameters of the four phases constituting the four-phase coexisting region and that improved magnetic properties can be accomplished by sintering of the magnet at a temperature lower than conventional when the chill crystalline phase having an average grain diameter not exceeding 3 $\mu$m are contained in a specific volume fraction as formed in the vicinity of the solidification front.

As is described above, the principal constituent elements of inventive thin alloy ribbon include a first constituent denoted by R which is a specific rare earth element, a second constituent denoted by T which is iron optionally in combination with another transition element and a third constituent denoted by B which is boron. The thin alloy ribbon of the invention is prepared by the strip casting method in which a melt of an alloy consisting of these essential and optional elements is continuously ejected at the surface of a rotating quenching roller of the single-roller type or twin-roller type so as to be solidified in the form of a ribbon having a thickness of 10 to 500 $\mu$m and a width of 5 to 500 mm. The conditions of quenching should be controlled in such a way that the requirements for the volume fractions of the four-phase coexisting region and the chill crystalline phase as well as the average diameters of the four phases constituting the four-phase coexisting region are satisfied. Precipitation of the four-phase coexisting regions and chilled crystals can be controlled by means of the material, thickness and diameter of the quenching roller, peripheral velocity of the quenching roller, rate of melt discharge out of the tundish and others. Assuming that the peripheral velocity of the quenching roller is 1.0 to 5.0 meters/second and the rate of melt discharge out of the tundish is 2 to 10 kg/second, for example, the thin alloy ribbons obtained have a thickness of 100 to 500 $\mu$m, in which the volume fractions of the four-phase coexisting regions and the chill crystals can well be controlled within the above mentioned ranges.

The average grain diameters of the four phases constituting the four-phase coexisting region including the $\alpha$-iron phase, R-rich phase, $R_xT_4B_4$ phase and $R_2T_{14}B$ phase should be in the ranges of from 0.1 to 20 $\mu$m, from 0.1 to 20 $\mu$m, from 0.1 to 10 $\mu$m and from 0.1 to 20 $\mu$m, respectively. When a fine powder of the thin alloy ribbon satisfying this requirement is compression-molded in a magnetic field followed by sintering of the molded powder compact, a reaction proceeds among the four phases to form fine grains of the $R_2T_{14}B$ phase from fine grains of the $\alpha$-iron phase, R-rich phase and $R_xT_4B_4$ phase. The reaction of these fine grains proceeds so actively that the $R_2T_{14}B$ phase newly formed by the reaction is bonded to the magnetically oriented existing $R_2T_{14}B$ phase without disturbing the magnetic orientation. Since the reaction proceeds among fine grains of the respective phases, furthermore, an improvement can be obtained in the sintering behavior of the alloy powder to give a sintered permanent magnet having an increased density of the sintered body and increased residual magnetic flux density. This advantageous effect can hardly be obtained when the average grain diameters of the respective phases do not satisfy the requirements.

The average grain diameters of the $\alpha$-iron phase, R-rich phase and $R_2T_{14}B$ phase can be determined by examining the secondary electron pattern or reflected electron pattern of a cross section of the thin alloy ribbon. While determination of the average grain diameter of the $R_xT_4B_4$ phase ($X=1+\epsilon$, $\epsilon$ being a positive number not exceeding 0.2 depending on the rare earth element R), in which the content of boron is relatively high, is difficult by the method of reflected electron pattern, the average grain diameter of the phase can be determined from the Auger electron pattern of the cross section formed by breaking.

The value of $\epsilon$, which is 0.1 or a number somewhat larger than 0.1 depending on the rare earth elements, as reported includes the values of 0.10–0.11 for praseodymium, 0.10–0.11 for neodymium, 0.14–0.16 for terbium and 0.15–0.16 for dysprosium. In each of these phases, the crystalline grains essentially have a grain diameter in the range from 0.1 to 20 $\mu$m or, preferably, from 0.1 to 10 $\mu$m, from 0.1 to 20 $\mu$m or, preferably, from 0.1 to 10 $\mu$m, from 0.1 to 10 $\mu$m or, preferably, from 0.1 to 5 $\mu$m and from 0.1 to 20 $\mu$m or, preferably, from 0.1 to 10 $\mu$m, respectively.

The volume fraction of the four-phase coexisting region in the inventive thin alloy ribbon should be in the range from 1 to 10% or, preferably, from 2 to 5%. When the volume fraction thereof is too large, a great decrease is caused in the coercive force and residual magnetic flux density of the permanent magnets prepared from the thin alloy ribbon. When the volume fraction of the region is too small, no substantial improvement can be obtained in the residual magnetic flux density of the permanent magnet. The volume fraction of the four-phase coexisting region can be determined from the secondary electron pattern or reflection electronic composition pattern of a cross section of the thin alloy ribbon.

The thin alloy ribbon of the present invention comprises the chill crystalline phase having an average grain diameter not exceeding 3 μm in the range from 1 to 30% volume fraction as formed in the vicinity of the solidification front when the alloy melt is quenched by contacting with the surface of the rotating quenching roller. When the volume fraction of the chill crystalline phase having an average grain diameter not exceeding 3 μm is within the above mentioned range, the reaction taking place among the phases constituting the four-phase coexisting region is promoted so that the reaction can proceed at a temperature lower by 10 to 50° C. than in the absence of the chill crystalline phase. Accordingly, grain growth of the $R_2T_{14}B$ phase is suppressed and improvements can be obtained in the density of the sintered body and the coercive force of the sintered permanent magnet even by sintering at a lower temperature than the conventional sintering temperature. When the volume fraction of the chill crystalline phase having an average grain diameter not exceeding 3 μm is too large, however, the coercive force of the permanent magnet is decreased because the fine particles are highly active and readily oxidized. The volume fraction of the chill crystalline phase having an average grain diameter not exceeding 3 μm in the inventive thin alloy ribbon can be determined from a reflection electronic composition pattern or from a polarizing microscopic photograph.

In the following, the present invention is described in more detail by way of Examples, which, however, never limit the scope of the invention in any way. In the Examples described below, the thin magnet alloy ribbons obtained in the above described manner were subjected to hydrogen decrepitation or mechanical pulverization by using a grinding machine such as a jet mill and Brown mill into fine particles, which were compression-molded in a magnetic field into a powder compact. The powder compact was subjected to a sintering heat treatment at a temperature of 900 to 1150° C. in an inert atmosphere of argon followed by an aging heat treatment at a temperature of 400 to 600° C. to give a rare earth-based sintered permanent magnet.

EXAMPLE 1 AND COMPARATIVE EXAMPLE 1

Neodymium, dysprosium, electrolytic iron, ferroboron, cobalt, aluminum and copper each in the elementary or metallic form were taken as the starting materials in a weight proportion of 30% Nd, 1% Dy, 4% Co, 1% B, 0.3% Al and 0.2% Cu, the balance being iron, and thin alloy ribbons having a thickness of from 50 to 1000 μm were prepared from an alloy melt of this composition by the strip casting method under varied quenching conditions including the peripheral velocity of the quenching roller of from 2.0 to 10.0 meters/second and melt discharge rate of from 3.0 to 15.0 g/second. The conditions of quenching in this strip casting process were controlled such that the volume fraction of the four-phase coexisting region fell within the range up to 13.7% and the volume fraction of the chill crystalline phase fell within the range from 10 to 15%. The average grain diameters of the α-iron phase, R-rich phase, $R_xT_4B_4$ phase and $R_2T_{14}B$ phase constituting the four-phase coexisting region were 3 μm, 7 μm, 1 μm and 10 μm, respectively.

FIG. 1 is a reflection electron pattern of a cross section of one of the above prepared thin alloy ribbons, of which the volume fraction of the four-phase coexisting region was 5%. In the figure, the black areas, gray areas and white areas correspond to the α-iron phase, $R_2T_{14}B$ phase and R-rich phase, respectively, each dispersed finely in the others within the four-phase coexisting region. The $R_xT_4B_4$ phase could not be exhibited on the pattern with such definiteness as to enable determination of the average grain diameter due to fineness of the grains and the high content of boron which was hardly detectable by the reflection electrons.

Figure 2:
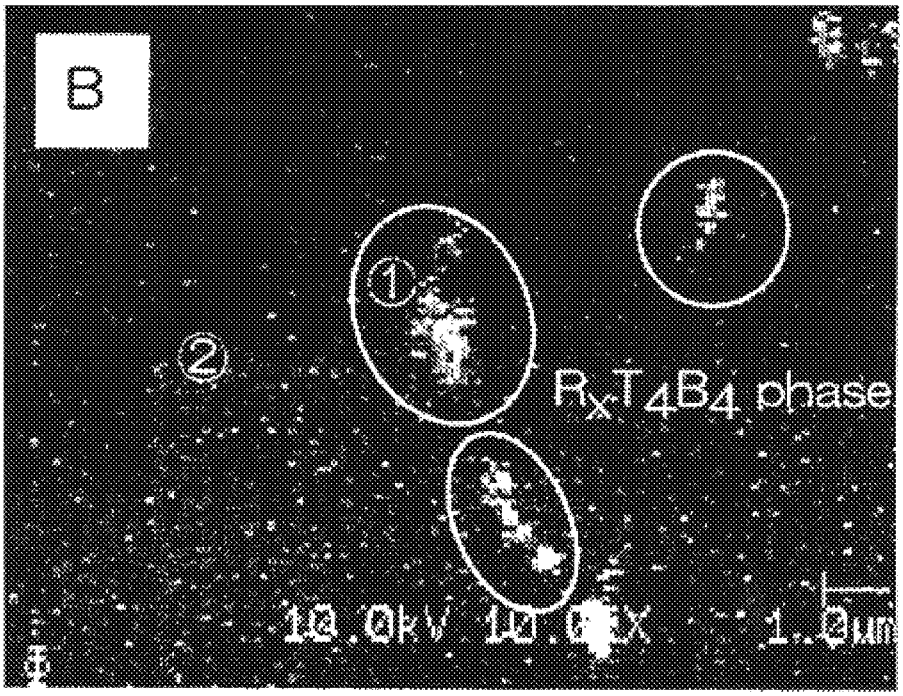
FIG. 2 is an Auger electron microscopic photograph of boron in the thin alloy ribbon for permanent magnets.
Figure 3:
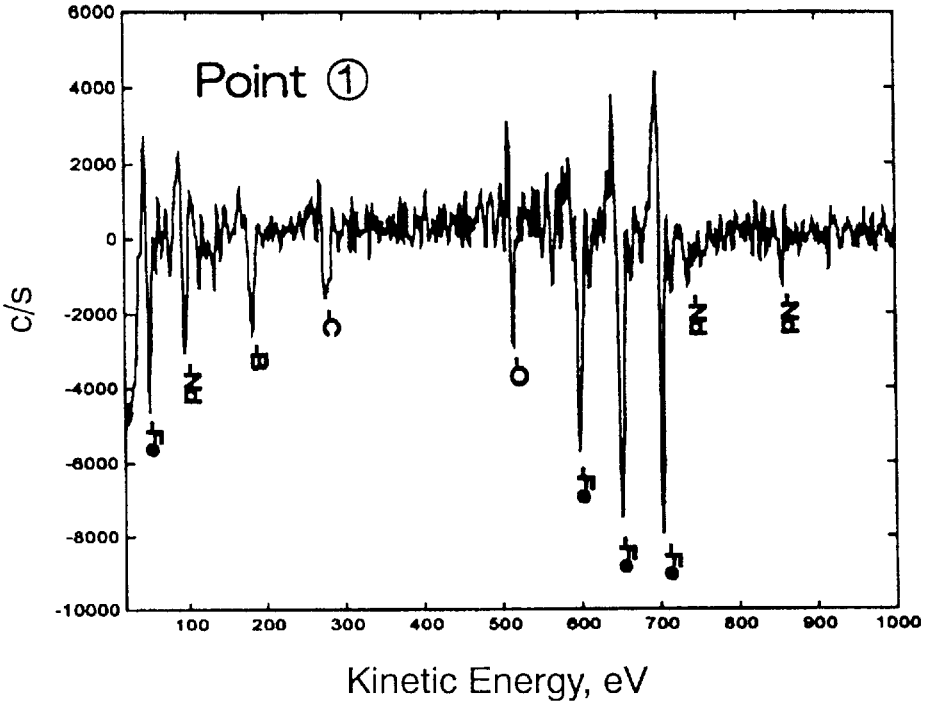
FIG. 3 is an Auger electron spectrum of the thin alloy ribbon for permanent magnets in the region indicated by ① in FIG. 2.
Figure 4:
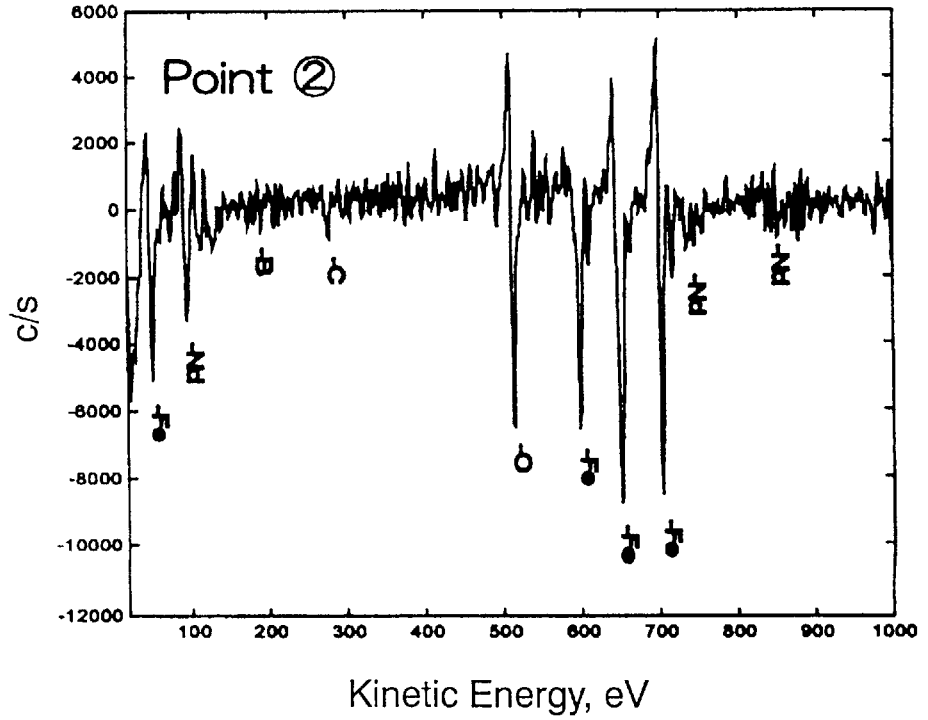
FIG. 4 is an Auger electron spectrum of the thin alloy ribbon for permanent magnets in the region indicated by ② in FIG. 2.

FIG. 2 is an Auger electron pattern of boron in the four-phase coexisting region of the same thin alloy ribbon as above. FIGS. 3 and 4 are each an Auger electron spectrum of the spots indicated by the marks ① and ②, respectively, on FIG. 2. As is understood from these figures, the spot of ① found within the four-phase coexisting region is a phase of $R_xT_4B_4$ which is rich in the content of boron as compared with the spot ② of the marginal phase. The average grain diameter of the $R_xT_4B_4$ phase was about 1 to 3 μm as determined from this figure.

In the next place, the thus prepared thin alloy ribbons were subjected to a hydrogen decrepitation treatment and then finely pulverized in a jet mill with nitrogen as the jet gas into fine particles having an average particle diameter of about 3 μm. The thus prepared fine alloy powder was put into a metal mold and shaped by compression-molding in a magnetic field of 12 kOe under a compressive force of 1 ton/cm$^2$ in a direction perpendicular to the direction of the magnetic field. The thus obtained powder compacts were sintered in an atmosphere of argon at 1050° C. for 2 hours followed by cooling and then subjected to an aging treatment also in an atmosphere of argon at 500° C. for 1 hour to give permanent magnets of different alloy compositions.

Figure 5:
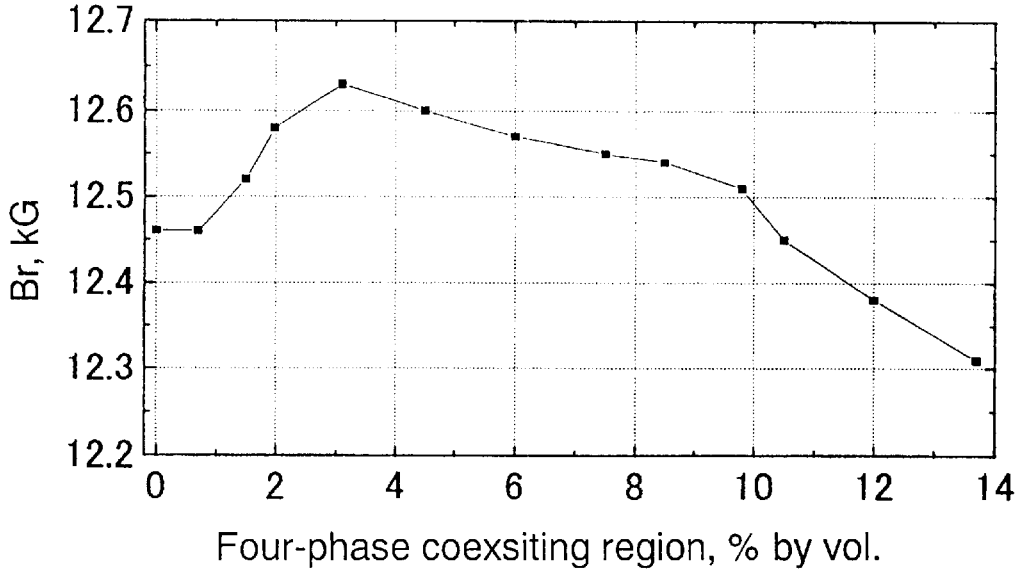
FIG. 5 is a graph showing the residual magnetic flux density Br of permanent magnets as a function of the volume fraction of the four-phase coexisting region (Example 1).

These permanent magnets were subjected to the measurement of the residual magnetic flux density Br to give the results shown in FIG. 5 as a function of the volume fraction of the four-phase coexisting region in the thin alloy ribbons from which the permanent magnets were prepared. As is understood from this graph, no improvement can be obtained in the residual magnetic flux density Br when the volume fraction is less than 1% while, when the volume fraction is in the range from 1 to 10%, the residual magnetic flux density can be improved substantially and the improvement is especially remarkable when the volume fraction is in the range from 2 to 5%. When the volume fraction exceeds 10%, on the other hand, the residual magnetic flux density is rather lower than with the volume fraction of less than 1%.

EXAMPLE 2 AND COMPARATIVE EXAMPLE 2

Thin alloy ribbons having a thickness of 50 to 1000 μwere prepared in about the same manner as in Example 1 from an alloy melt consisting of 28% by weight of neodymium, 0.3% by weight of dysprosium, 1% by weight of cobalt, 1.1% by weight of boron, 0.3% by weight of aluminum and 0.1% by weight of copper, the balance being iron. The quenching conditions in the strip casting process were controlled in such a way that the volume fraction of the four-phase coexisting region was in the range up to 13.5% and the volume fraction of the chill crystalline phase was in the range up to about 14%. The average grain diameters of the α-iron phase, R-rich phase, $R_xT_4B_4$ phase and $R_2T_{14}B$ phase in the four-phase coexisting region were 3 μm, 5 μm, 1 μm and 15 μm, respectively.

These thin alloy ribbons were processed into permanent magnets in the same manner as in Example 1 except that each of the fine powders of the thin alloy ribbons was admixed with 10% by weight of a sintering aid and the sintering temperature was 1070° C. The sintering aid was an alloy composition consisting of 45% of neodymium, 15% of dysprosium, 20% of cobalt, 0.5% of boron, 1.0% of calcium and 0.5% of aluminum in atomic proportions, the balance being iron.

Figure 6:
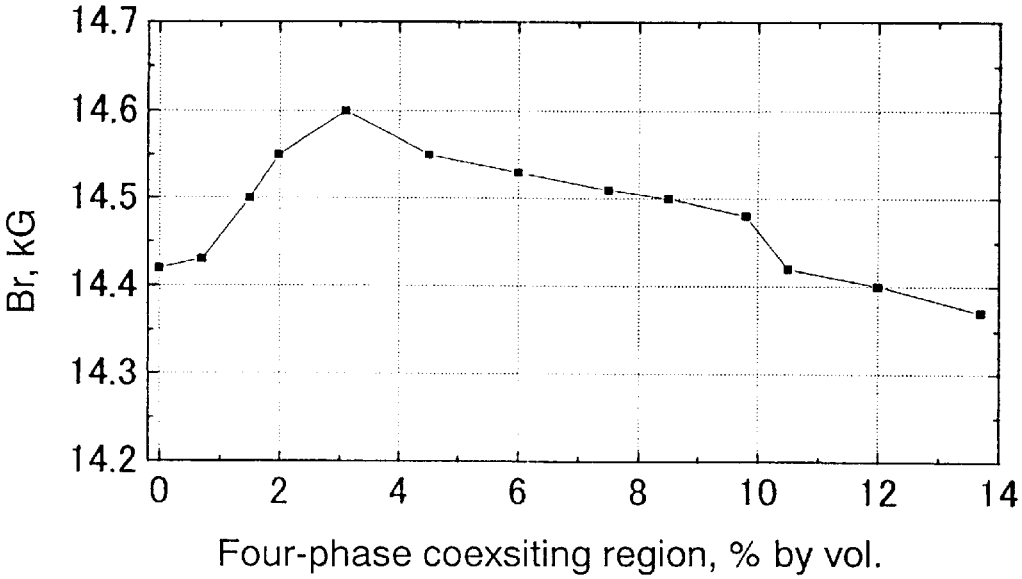
FIG. 6 is a graph showing the residual magnetic flux density Br of permanent magnets as a function of the volume fraction of the four-phase coexisting region (Example 2).

The results of the measurements of the residual magnetic flux density Br are shown in FIG. 6 as a function of the volume fraction of the four-phase coexisting region in the thin alloy ribbons from which the permanent magnet was prepared. As is understood from this graph, no improvement can be obtained in the residual magnetic flux density Br when the volume fraction is less than 1% while, when the volume fraction is in the range from 1 to 10%, the residual magnetic flux density can be improved substantially and the improvement is especially remarkable when the volume fraction is in the range from 2 to 5%. When the volume fraction exceeds 10%, on the other hand, the residual magnetic flux density is rather lower than with the volume fraction of less than 1%.

Figure 7:
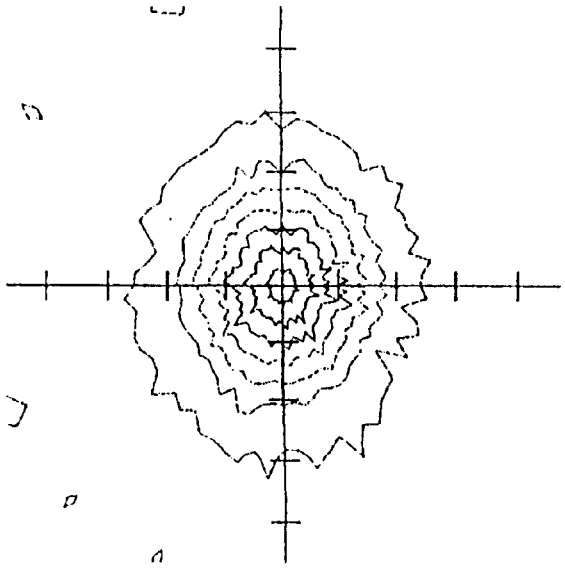
FIG. 7 is a (006) polar diagram when the volume fraction of the four-phase coexisting region is 0.5%.
Figure 8:
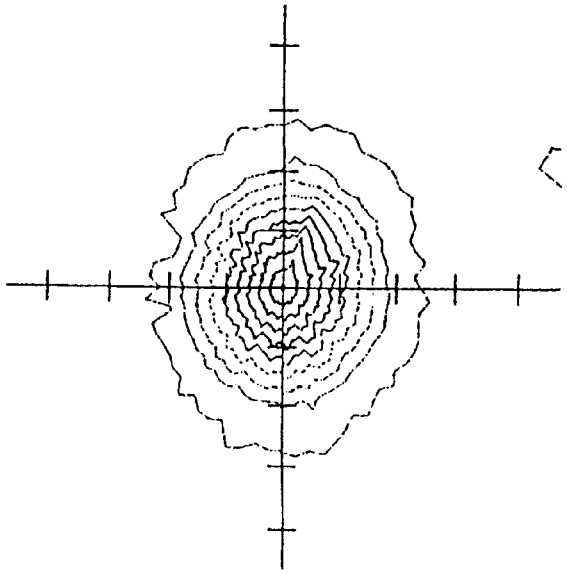
FIG. 8 is a (006) polar diagram when the volume fraction of the four-phase coexisting region is 3%.

The sintered bodies prepared from powders of the thin alloy ribbons in which the volume fraction of the four-phase coexisting region was 0.5% and 3% were subjected to the measurement of the (006) X-ray polar diagrams to estimate the influence of the volume fraction on the degree of crystalline orientation in the sintered bodies to give the results shown in FIG. 7 and FIG. 8, respectively. As is clear from comparison of these diagrams, the distribution density of the contour lines in FIG. 8 is much larger than in FIG. 7 indicating a great influence of the volume fraction of the four-phase coexisting region on the degree of orientation.

The magnetic properties including residual magnetic flux density Br, coercive force iHc and maximum energy product $(BH)_{max}$ and the sintering density d are shown in Table 1 for the permanent magnet prepared from the thin alloy ribbon in which the volume fractions of the four-phase coexisting region and the chill crystalline phase were 10.0% and 3.1%, respectively.

EXAMPLE 3

Thin alloy ribbons having a thickness of 800 $\mu$m were prepared in about the same manner as in Example 1 except that the peripheral velocity of the quenching roller was 7 meters/second and the melt discharge rate was 12 g/second from an alloy melt consisting of 28% by weight of neodymium, 0.3% by weight of dysprosium, 1% by weight of cobalt, 1.1% by weight of boron, 0.3% by weight of aluminum and 0.1% by weight of copper, the balance being iron. The quenching conditions in the strip casting process were controlled in such a way that the volume fraction of the four-phase coexisting region was 2.1% and the volume fraction of the chill crystalline phase was 10%. The average grain diameters of the α-iron phase, R-rich phase, $R_xT_4B_4$ phase and $R_2T_{14}B$ phase in the four-phase coexisting region were 20 $\mu$m, 15 $\mu$m, 7 $\mu$m and 10$\mu$m, respectively.

The thin alloy ribbons were processed into permanent magnets in the same way as in Example 1 except that the fine powder of the thin alloy ribbons was admixed with 10% by weight of the sintering aid and the sintering temperature was 1090° C.

The magnetic properties and the sintering density of the permanent magnet are shown in Table 1.

Comparative Example 3.

Thin alloy ribbons having a thickness of 700 $\mu$m were prepared in about the same manner and from an alloy melt of the same alloy composition as in Comparative Example 3 except that the quenching conditions were controlled in such a way that the volume fraction of the four-phase coexisting region was 1.9% and the volume fraction of the chill crystalline phase was 0.2%. The peripheral velocity of the quenching roller was 5 meters/second and the melt discharge rate was 10 g/second. The average grain diameters of the α-iron phase, R-rich phase, $R_xT_4B_4$ phase and $R_2T_{14}B$ phase in the four-phase coexisting region were 3 $\mu$m, 5 $\mu$m, 1 $\mu$m and 13 $\mu$m, respectively.

The thin alloy ribbons were processed into permanent magnets in the same way as in Comparative Example 3 except that the sintering temperature was 1100° C.

The magnetic properties and the sintering density of the permanent magnet are shown in Table 1.

Comparative Example 4

Thin alloy ribbons having a thickness of 500 $\mu$m were prepared in about the same manner and from an alloy melt of the same alloy composition as in Comparative Example 3 except that the quenching conditions were controlled in such a way that the four-phase coexisting region was not formed and the volume fraction of the chill crystalline phase was 0.5%. The peripheral velocity of the quenching roller was 5 meters/second and the melt discharge rate was 7 g/second.

The thin alloy ribbons were processed into permanent magnets in the same manner as in Comparative Example 3 except that the sintering temperature was 1100° C.

The magnetic properties and the sintering density of the permanent magnet are shown in Table 1.

According to the results of the evaluation tests, the sintered permanent magnet suffer, as a trend, a decrease in the squareness ratio and, further, a decrease in the residual magnetic flux density when the α-iron phase, R-rich phase, $R_xT_4B_4$ phase and $R_2T_{14}B$ phase has a large average grain diameter.

Further, it was necessary in Comparative Examples 3 and 4, in which the volume fraction of the chill crystalline phase was low, that the sintering temperature was increased to 1100° C. in order to obtain a sintering density of the magnet comparable to that in Example 2 in which the sintering temperature was 1070° C.

TABLE 1

| | Br, kG | iHc, kOe | $(BH)_{max}$, MGOe | Density, g/cm$^3$ |
|---|---|---|---|---|
| Example 2 | 14.60 | 14.2 | 49.8 | 7.55 |
| Example 3 | 14.30 | 13.1 | 47.5 | 7.51 |
| Comparative Example 3 | 13.60 | 13.4 | 43.4 | 7.53 |
| Comparative Example 4 | 13.52 | 13.6 | 43.1 | 7.49 |

What is claimed is:

1. A rare earth permanent magnet which is a sintered block of a powder of a thin alloy ribbon prepared by the strip casting method from a melt of an alloy comprising a rare earth element R selected from the group consisting of praseodymium, neodymium, terbium and dysprosium, element T which is iron or a combination of iron with a transition metal element other than iron and rare earth elements and boron B, which comprises from 1 to 10% by volume fraction of a four-phase coexisting region consisting of an αiron phase having an average grain diameter of 0.1 to 20 $\mu$m, R-rich phase having an average grain diameter of 0.1 to 20 $\mu$m, $R_XT_4B_4$ phase, the subscript x being a number larger than 1 but smaller than 1.2, having an average grain diameter of 0.1 to 10 $\mu$m and $R_2T_{14}B$ phase having an average grain diameter of 0.1 to 20 $\mu$m and from 1 to 30% by volume fraction of a chill crystalline phase having an average grain diameter not exceeding 3 $\mu$m, the balance of the volume fractions consisting of a combination of the R-rich phase, $R_XT_4B_4$ phase and $R_2T_{14}B$ phase of a combination of the R-rich phase and $R_2T_4B$ phase.

2. A rare earth permanent magnet as claimed in claim 1 in which the average grain diameters of the α-iron phase, R-rich phase, $R_XT_4B_4$ phase and $R_2T_{14}B$ phase are in the ranges from 0.1 to 10 μm, from 0.1 to 10 μm, from 0.1 to 10 μm and from 0.1 to 10 μm, respectively.

3. The rare earth permanent magnet as claimed in claim 1 in which the volume fraction of the four-phase coexisting region is in the range from 2 to 5%.

* * * * *